US006431148B1

(12) United States Patent
Guggenbichler et al.

(10) Patent No.: US 6,431,148 B1
(45) Date of Patent: Aug. 13, 2002

(54) FUEL INJECTION DEVICE FOR INTERNAL COMBUSTION ENGINES

(75) Inventors: Franz Guggenbichler; Jaroslaw Hlousek, both of Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/155,113

(22) PCT Filed: Sep. 13, 1997

(86) PCT No.: PCT/DE97/02053

§ 371 (c)(1),
(2), (4) Date: Sep. 21, 1998

(87) PCT Pub. No.: WO98/31933

PCT Pub. Date: Jul. 23, 1998

(30) Foreign Application Priority Data

Jan. 21, 1997 (DE) ..... 197 01 879

(51) Int. Cl.[7] ..... F02M 37/04
(52) U.S. Cl. ..... 123/467; 123/500
(58) Field of Search ..... 123/467, 500, 123/501, 506, 458; 251/30.02

(56) References Cited

U.S. PATENT DOCUMENTS 4,249,497 A 2/1981 Eheim ..... 123/467
5,660,368 A * 8/1997 Matthaeis et al. ..... 251/30.02
5,862,793 A 1/1999 Jay ..... 123/467
5,893,350 A 4/1999 Timms ..... 123/467
5,915,361 A 6/1999 Heinz ..... 123/467
5,941,215 A 8/1999 Augustin ..... 123/467
5,950,600 A 9/1999 Ricco ..... 123/467

FOREIGN PATENT DOCUMENTS

DE 19512270 * 9/1996
DE 19612738 * 10/1996

* cited by examiner

*Primary Examiner*—Carl S. Miller
(74) *Attorney, Agent, or Firm*—Ronald E. Greigg

(57) ABSTRACT

A fuel injection device for internal combustion engines, having a high-pressure collection chamber (common rail), which can be filled with fuel by a high-pressure pump and which communicates via injection lines with injection valves that protrude into the combustion chamber of the engine to be supplied, the opening and closing motions of the injection valves each being controlled by an electrically triggered control valve. The control valve is embodied as a 3/2-way valve which connects a high-pressure conduit, discharging at an injection port of the injection valve, with the injection line or a relief line. On the control valve member of the control valve, a hydraulic work chamber that can be filled with high fuel pressure is provided, which can be opened into a relief conduit in order to adjust the set position of the control valve member of the control valve.

14 Claims, 8 Drawing Sheets

FUEL INJECTION DEVICE FOR INTERNAL COMBUSTION ENGINES

Prior Art

The invention is based on a fuel injection device for internal combustion engines. In one such fuel injection device, known from European Patent Disclosure EP 0 657 642, a high-pressure fuel pump pumps fuel from a low-pressure chamber into a high-pressure collection chamber, which communicates via injection lines with the individual injection valves that protrude into the combustion chamber of the engine to be supplied; this common pressure storage system (common rail) is kept at a certain pressure level by a pressure control device. To control the injection times and quantities at the injection valves, an electrically triggered control valve is provided on each of the injection valves and with its opening and closing it controls the high-pressure fuel injection at the injection valve. The control valve of the known fuel injection device is embodied as a 3/2-way valve, which connects a high-pressure conduit, discharging at the injection port of the injection valve, with the injection line leading away from the high-pressure collection chamber or with a relief line into a low-pressure chamber. In this way, it is attained that the high fuel pressure present in the common high-pressure collection chamber and in the injection lines will not act upon the injection valve during the intervals between injections, so that its closing forces can be correspondingly less, with high system safety, because of the pressure relief of the high-pressure line.

Since in the known fuel injection device the 3/2-way control valve is actuated directly by the actuator of an electrically triggered magnet valve, the known fuel injection device has the disadvantage that the stroke course of the magnet valve defines the adjusting motion at the valve slide of the 3/2-way control valve. Furthermore, the closing force at the 3/2-way control valve, which counteracts the high fuel pressure, is brought to bear solely by the restoring spring of the magnet valve, so that this spring holding force of the magnet valve limits the maximum system pressure in the high-pressure fuel portion, which pressure prevails at the control valve, to a value that no longer meets current needs.

ADVANTAGES OF THE INVENTION

The fuel injection device according to the invention for internal combustion engines, has the advantage over the prior art that the electrically actuated magnet valve actuates the control valve member of the 3/2-way control valve with the interposition of a hydraulic work chamber. A hydraulic stepup at the valve member of the control valve can be achieved by how the face or surface area of the control valve member that defines the hydraulic work chamber is designed, so that this valve acts like a servo piston. In this way, the adjustment path of the control valve member of the 3/2-way control valve becomes independent of the stroke of the magnet valve, and the hydraulic work chamber at the same time performs the restoring function of the control valve member, so that even very high system pressures of over 2000 bar in the high-pressure fuel portion are possible. Furthermore, the pressure in the work chamber, with a buildup of the system pressure, keeps the control valve in a position that closes the flow between the injection line and the high-pressure conduit, so that with a very high effective closing pressure, it is possible to dispense with an additional closing spring.

The hydraulic work chamber at the control valve is advantageously defined by an upper end face of the piston-like valve member of the control valve and is constantly supplied with fuel at high pressure from the injection line via a throttle cross section between the control valve member and the bore wall that guides it. In addition, on the side remote from the valve member of the control valve, a relief line leads away from the hydraulic work chamber; this line can be opened and closed by the magnet valve. This relief line advantageously has a greater cross section than the throttle cross section to the injection line, so that the pressure in the hydraulic work chamber can be very rapidly relieved upon opening of the relief line.

The control valve is advantageously embodied as a double seat valve, the two valve seat faces of which are oriented toward one another, so that the adjusting motion of the control valve member is limited in each case by contact with one of the valve seats, which reduces possible leakage losses to a minimum. The throttle distance between the injection line and the hydraulic work chamber is formed, in a first exemplary embodiment, by a throttle bore in the control valve member. Alternatively, however, this throttling distance may also be formed by a residual throttling annular gap between the wall of the pistonlike control valve member and the bore wall guiding it.

The region of the control valve member adjoining the second valve seat between the high-pressure conduit and a relief line is guided in sliding fashion along the wall of the receiving bore and thus forms a guide for the control valve member. For a fuel overflow into the relief line, overflow openings on the control valve member are provided, which may be formed for instance by means of a surface chamfer on the control valve member or by suitable through bores.

A further advantage can be attained by providing a stroke-controlled throttle between the first and second sealing seats of the control valve, by which seats the quantity of fuel overflowing from the injection line to the high-pressure conduit is throttled in a first phase of the injection event.

The provision of a restriction in the relief line can moreover reinforce the closing of the injection valve at the end of injection and avert possible dribbles after injection. In addition, by means of this outflow throttle, the residual pressure at the injection valve after the termination of the fuel injection is controlled in such a way that cavitation in the high-pressure conduit can be avoided.

It is thus possible with the fuel injection device of the invention, with relatively low actuating forces and relatively short strokes of the magnet valve, to control large supply quantities and high pressures at the injection valve.

Further advantages and advantageous features of the subject of the invention can be learned from the specification, claims and drawing.

BRIEF DESCRIPTION OF THE DRAWING

Six exemplary embodiments of the fuel injection device according to the invention for internal combustion engines are shown in the drawing and will be described in further detail below.

DESCRIPTION OF THE EXEMPLARY EMBODIMENTS

Figure 1:
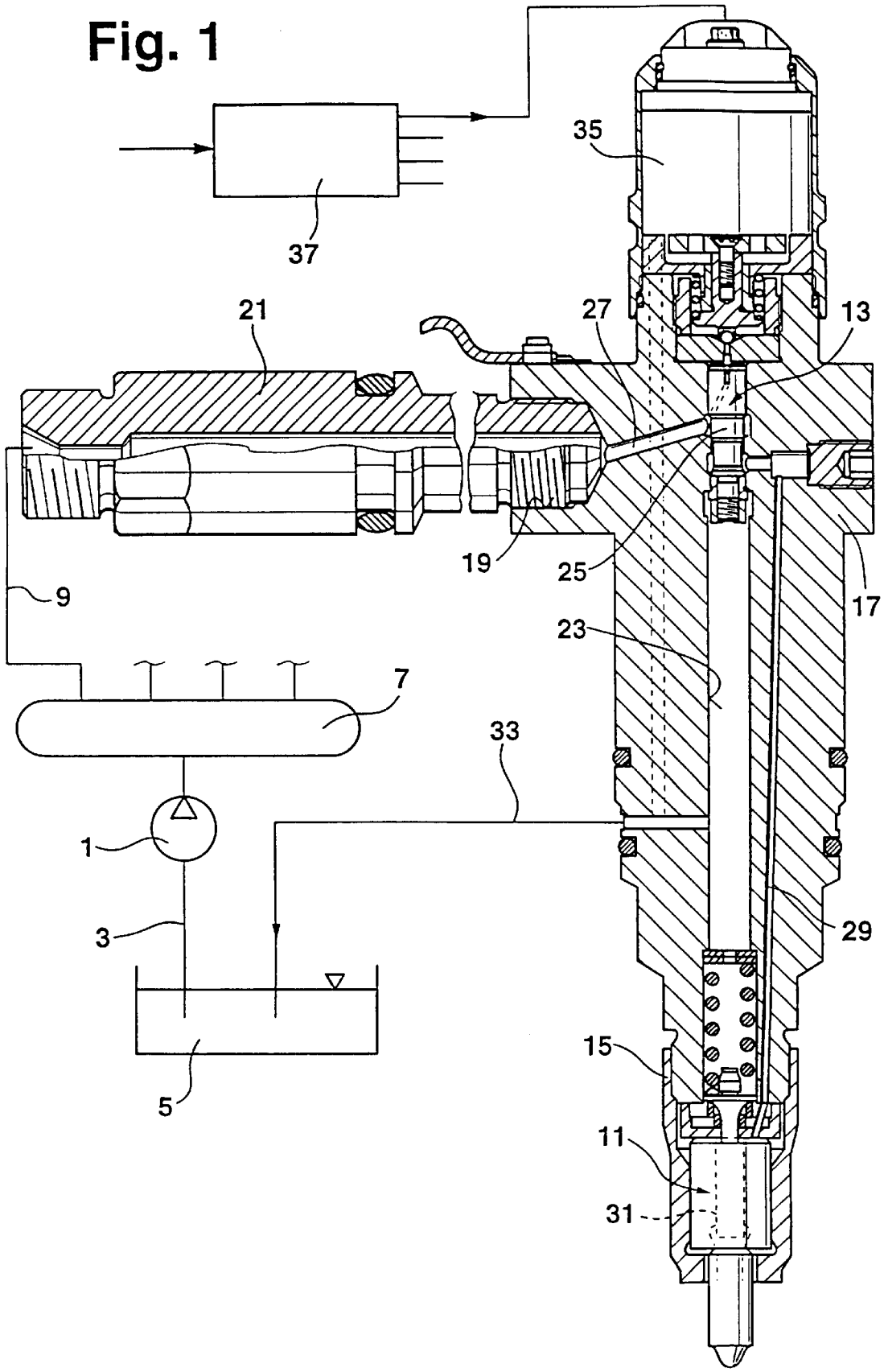
FIG. 1 shows a first exemplary embodiment in an overall view, in which the throttle distance between the injection line and the hydraulic work chamber is embodied at the control valve, by a throttle bore in its control valve member.

The first exemplary embodiment, shown in FIG. 1, of the fuel injection device for internal combustion engines has a high-pressure fuel pump 1, which communicates on the intake side, via a fuel feed line 3, with a fuel-filled low-pressure chamber 5 and on the compression side, via the feed line 3, with a high-pressure collection chamber 7. From this high-pressure collection chamber 7, injection lines 9 lead to the individual injection valves 11 that protrude into the combustion chamber of the engine to be supplied; for controlling the injection event, one electrically actuatable control valve 13, embodied as a 3/2-way valve, is provided on each injection valve 11.

The injection valve 11 is braced axially by a tightening nut 15 against a valve holding body 17, on which a lateral high-pressure connection 19 is provided, into which a tubular stub 21 of the corresponding injection line 9 is inserted. The valve holding body 17 has an axial through bore 23, into which a pistonlike control valve member 25 of the control valve 13 is inserted, on the side remote from the injection valve 11. This control valve 13, embodied as a double-seat valve, thus connects a connecting conduit 27, leading away from the injection line 9 in the tubular stub 21, with a high-pressure conduit 29 that axially penetrates the valve holding body 17 and that discharges in a known manner, at an end face of the valve holding body 17 remote from the injection valve 11, at a pressure line, not identified by reference numeral, in the injection valve 11; on its other end the pressure line discharges as far as an injection cross section of the injection valve 11 that can be opened by a valve needle 31 of the injection valve 11. The high-pressure conduit 29 can be connected via the control valve 13 alternatingly with the injection line 9 or a relief line 33, the latter being formed of the part of the through bore 23 toward the injection valve and a return line leading away from the through bore, and the relief line discharges into the low-pressure chamber 5. The adjusting motion of the control valve member 25 of the control valve 13 is controlled by a magnet valve 35, which is inserted into the valve holding body 17 on the side remote from the injection valve 11 and is triggered by an electric control unit 37 that processes many operating parameters of the engine to be supplied.

Figure 2:
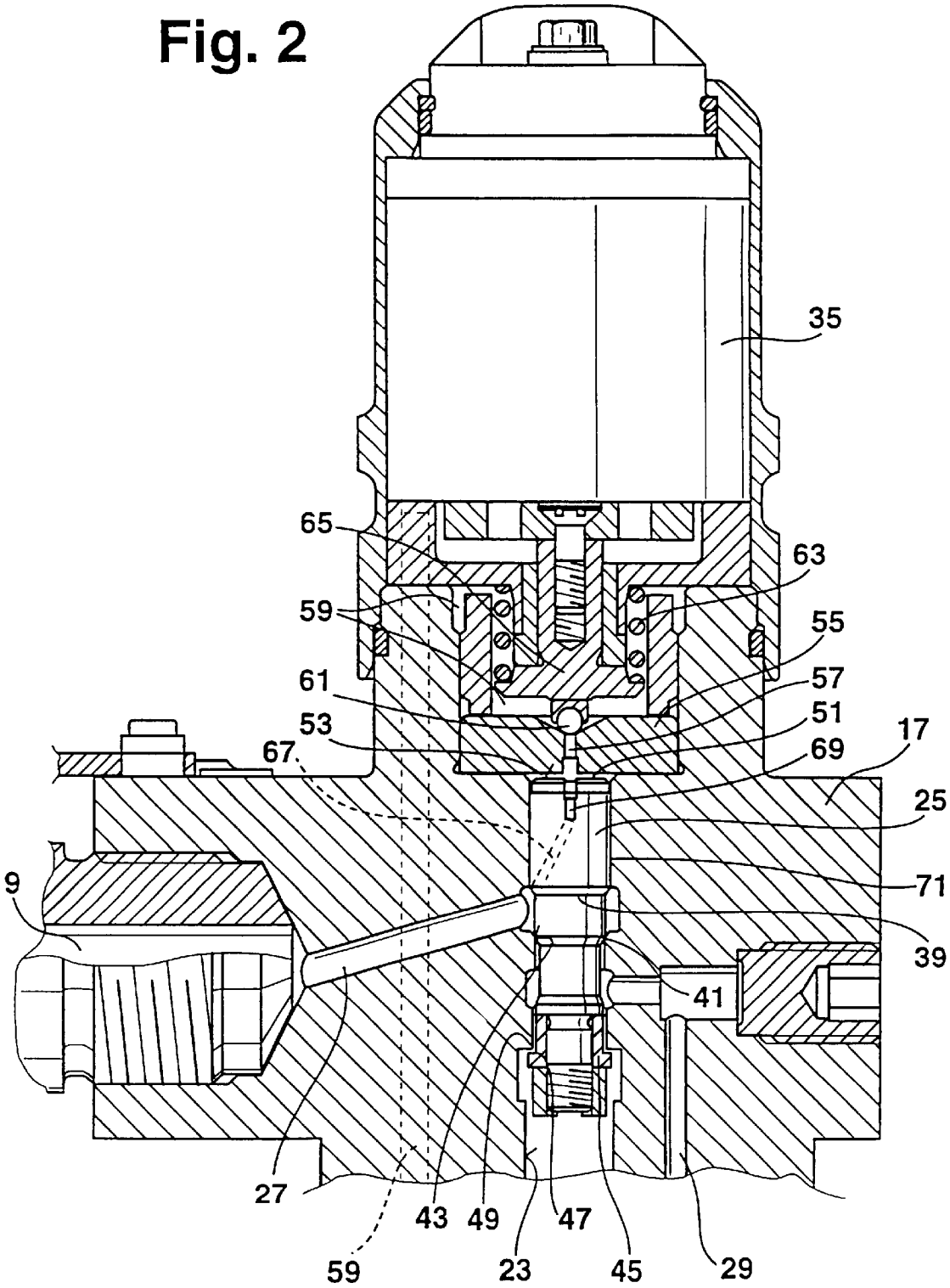
FIG. 2 is an enlarged sectional view through the control valve of FIG. 1.

The control valve member 25, shown enlarged in FIG. 2, of the control valve 13 is embodied as a stepped piston, whose cross section narrows toward the bottom in the direction of the injection valve 11 by way of two conically embodied annular faces. A first, upper annular end face 39 is provided in the region of the orifice of the connecting conduit 27 toward the injection line 9. A second annular end face forms a first conical valve sealing face 41, which cooperates with a first conical valve seat 43, which between the valve sealing face 41 and the first sealing seat formed by the valve 43 closes the injection line 9 off from the high-pressure conduit 29. On its lower end, toward the injection valve 11, the control valve member 25 has a sleeve 45, on which a second valve sealing face 47, oriented toward the first valve sealing face 41, is provided. This second sealing face cooperating with a second valve seat 49 on the wall of the through bore 23. The valve faces 43 and 49 are formed such that they limit the adjusting motion of the control valve member 25 in both stroke directions. The second sealing cross section formed between the second valve sealing face 47 and the second valve seat face 49 closes the communication between the high-pressure conduit 29 and the relief line 33, partly formed by the through bore 23, into the low-pressure chamber 5.

For actuating the control valve member 25, a hydraulic work chamber 51 is provided, which is defined by the upper end face 53, remote from the injection valve 11, of the control valve member 25 in the bore 23. On the side remote from the control valve member 25, the hydraulic work chamber 51 is defined by an intermediate disk 55 toward the magnet valve 35. A relief conduit 57 leading away from the work chamber 51 is provided in this intermediate disk 57; the relief conduit discharges into a return conduit 59 discharging into the low-pressure chamber 5 and is closable by a valve member of the magnet valve 35. This valve member of the magnet valve 35 is embodied as a valve ball 61, which is guided in a valve seat adjoining the relief conduit 57 and which, when the magnet valve 35 is switched to be without current, keeps the relief conduit 57 closed by the force of a magnet valve spring 63. The valve ball 61 is pivotably connected to an armature 65 of the magnet valve 35; when the magnet valve 35 does have current, this armature is displaced, counter to the restoring force of the spring 63, in the direction away from the work chamber 51, so that the valve ball 61 is lifted from its seat by the pressure prevailing in the work chamber 51, and the relief conduit 57 is opened toward the return line 59.

For filling the hydraulic work chamber 51 with a fuel at high pressure, a filling bore 67 is provided in the control valve member 25; this bore has a throttle restriction 69, whose cross section is smaller than the cross section of the relief conduit 59. This filling bore 67, discharging into the end face 53, leads away below the first annular end face 39 of the control valve member 25, so that the hydraulic work chamber 51 communicates at all times with the injection line 9 via the filling bore 67. In addition to this filling of the hydraulic work chamber 51, some of the high-pressure fuel quantity passes in throttled fashion via the annular gap 71 that remains, between the control valve member 25 and the wall of the bore 23, into the hydraulic work chamber 51, so that emergency operation of the control valve 13 is assured even if the filling bore 67 should possibly close.

The fuel injection device shown in FIGS. 1 and 2 in a first exemplary embodiment for internal combustion engines functions as follows. Upon startup of the system, a high fuel pressure is first built up, via the high-pressure fuel pump 1, in the common high-pressure collection chamber 7 (common rail), which continues via the various injection lines 9 as far as the various valve holding bodies 17 of the injection valves 11. Before the onset of the injection phase, the magnet valve 35 is switched to be without current, so that the valve ball 61 of the magnet valve 35 keeps the relief conduit 57 closed. In the process, the hydraulic work chamber 51 is filled with high fuel pressure via the filling bore 67 and, because of the ratio of the areas of the end face 53 and the first annular end face 39, this pressure presses the control valve member 25 with the first valve sealing face 41 against the first valve seat 43. This closes the communication between the injection line 9 and the high-pressure conduit 29 discharging at the injection cross section of the injection valve 11. At the same time, the second cross section between the second valve sealing face 47 and the second valve seat 49 is as shown in FIG. 2, so that the pressure in the high-pressure conduit 29 can be relieved down to a certain residual pressure into the relief line 33. If injection is to occur at the injection valve 11, then first electric current is supplied to the magnet valve 35 via the electric control unit 37, so that the armature 65 is attracted and the valve ball 61 uncovers the relief conduit 57. Since the cross section of the relief conduit 57 is greater than that of the throttle restriction 69 in the filling bore 67, the pressure in the work chamber 51 is very rapidly relieved via the magnet valve chamber into the return conduit 59, so that the high fuel pressure prevailing at the annular end face 39 now suffices to displace the control valve member 25. In this opening stroke motion, the control valve member 25 is displaced in such a way that the first sealing cross section between the first valve sealing face 41 and the first valve seat 43 is now opened, and the second sealing seat, between the second valve sealing face 47 and the second valve seat 49, is closed by contact of the control valve member 25 with the second valve seat 49. The fuel at high pressure located in the injection line 9 now flows along the control valve member 25 into the high-pressure conduit 29 to reach the injection valve 11, where in a known manner it lifts the valve needle 31 away from its needle seat, counter to the restoring force of a valve spring, so that the fuel is injected at the injection valve 11 via the injection ports into the combustion chamber of the engine to be supplied.

The high-pressure injection at the injection valve 11 is ended by switching the magnet valve 35 to be currentless again, and as a consequence the magnet valve spring 63 displaces the valve ball 61 back onto its seat at the relief conduit 57, so that via the filling bore 67 a closing pressure in the hydraulic work chamber 51 can build up again, which again displaces the control valve member 25 of the control valve 13, embodied as a 3/2-way valve, so that the first valve sealing face 41 contacts the first valve seat 43. This closes the communication of the injection line 9 and the high-pressure conduit 29 again. At the same time, the second sealing seat between the second valve 47 and the second valve 49 is opened again, so that the high fuel pressure located in the high-pressure conduit 29 is very rapidly relieved into the relief line 33, resulting in a rapid needle closure at the fuel injection valve 11.

Figure 3:
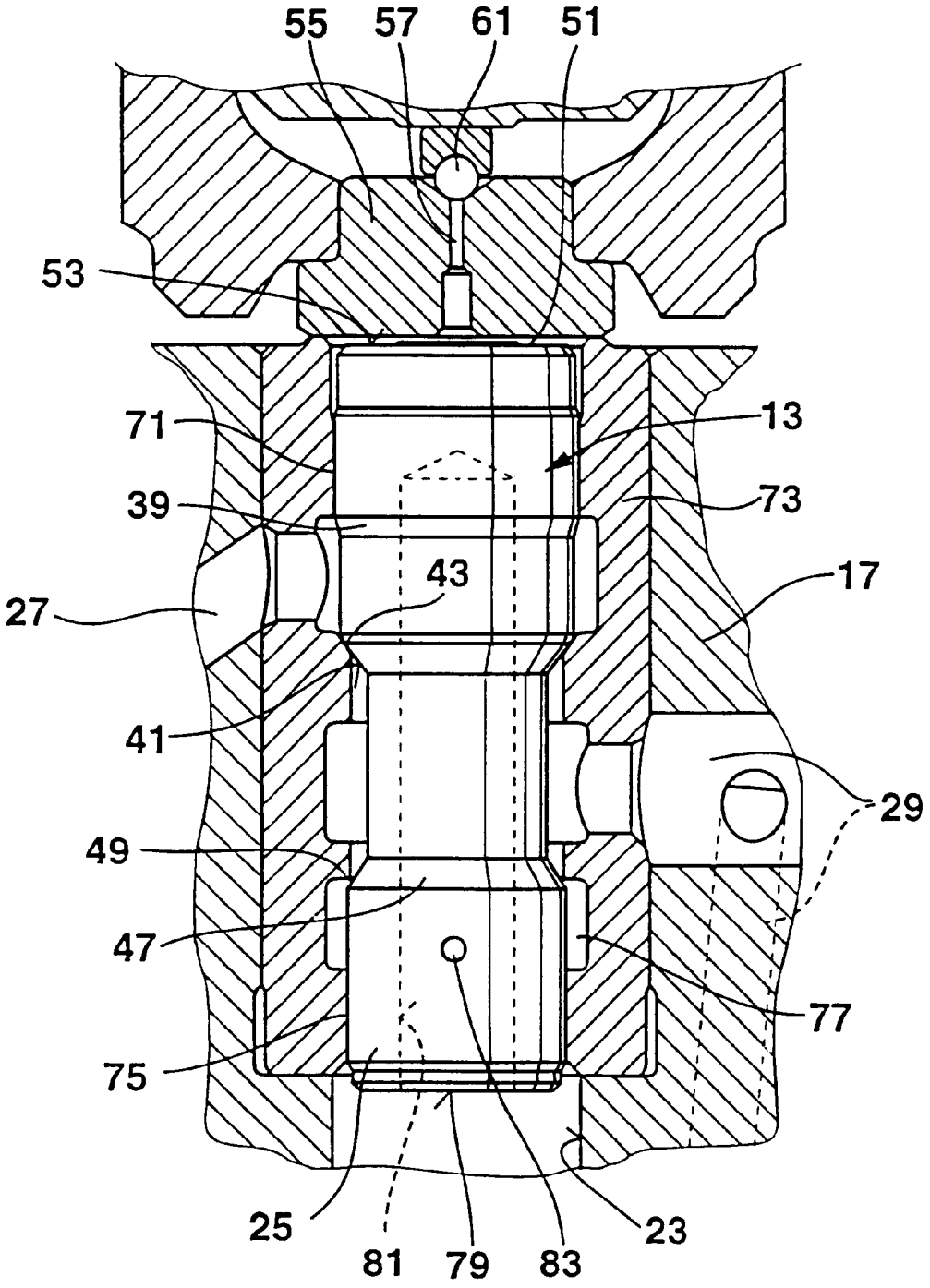
FIG. 3 shows a second exemplary embodiment, analogous to the view in FIG. 2, with a control valve member guide in the lower region that communicates with the relief chamber via a throttle bore, and in which embodiment the throttle cross section between the injection line and the hydraulic work chamber is formed via an annular gap between the valve member of the control valve and the bore wall guiding it.

The second exemplary embodiment, shown in FIG. 3, of the fuel injection device according to the invention differs from the first exemplary embodiment in the way in which the control valve member 25 of the control valve 13 is embodied. The control valve member 25 is now in one piece and is guided in a cylinder bush 73 inserted into the through bore 23 of the valve holding body 17. A lower portion of the cross section of the control valve member 25, remote from the magnet valve 35, then forms a guide part 75 of the control valve member 25, and this part slides with little play in the inside diameter of the cylinder bush 73. Filling of the hydraulic work chamber 51 moreover now takes place, in the second exemplary embodiment, only via the annular gap 71 between the control valve member 25 and the inner wall of the cylinder bush 73. The annular gap 71 is embodied as a throttle restriction, in such a way that the total flow cross section is smaller in embodiment than the cross section of the relief conduit 57 of the hydraulic work chamber 51. The outflow of fuel from a relief chamber 77, downstream of the second sealing seat between the valve sealing face 47 and the valve seat 49, into the relief line 23, 33 is effected via a blind bore 81, which begins at the lower end face 79, remote from the upper end face 53, in the control valve member 25 and from which a transverse bore 83 leads away, the transverse bore being embodied as a throttle bore and discharging into the relief chamber 77.

Figure 4:
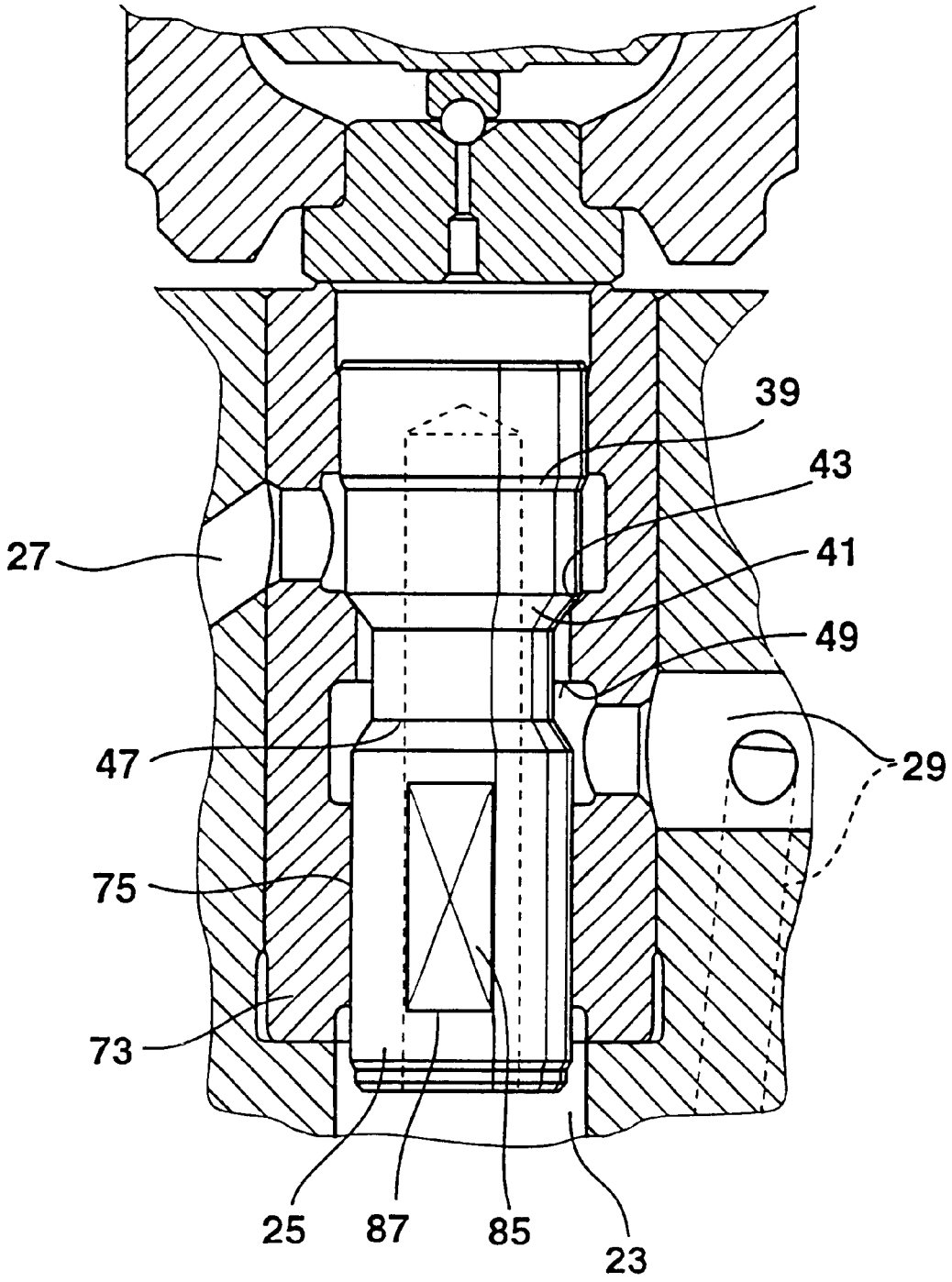
FIG. 4 shows a third exemplary embodiment, analogous to the view of FIG. 3, in which flattened faces are provided at the guide diameter of the control valve member.

In the third exemplary embodiment, shown in FIG. 4, the overflow of fuel from the high-pressure conduit 29 into the relief line 23, 33 takes place via a surface chamfer 85 at the circumferential surface of the control valve member 25 in the guide region 75. The axial length of this rectangularly embodied surface chamfer 85 is made such that the upper part of the surface chamfer, oriented toward the magnet valve 35, communicates constantly with the high-pressure conduit 29, while the lower end of the surface chamfer 85, forming a control edge 87, does not emerge from coincidence with the cylinder bush 73 until the first valve sealing face 41 contacts the first valve seat 43; this additionally contributes to the system safety of the fuel injection device.

Figure 5:
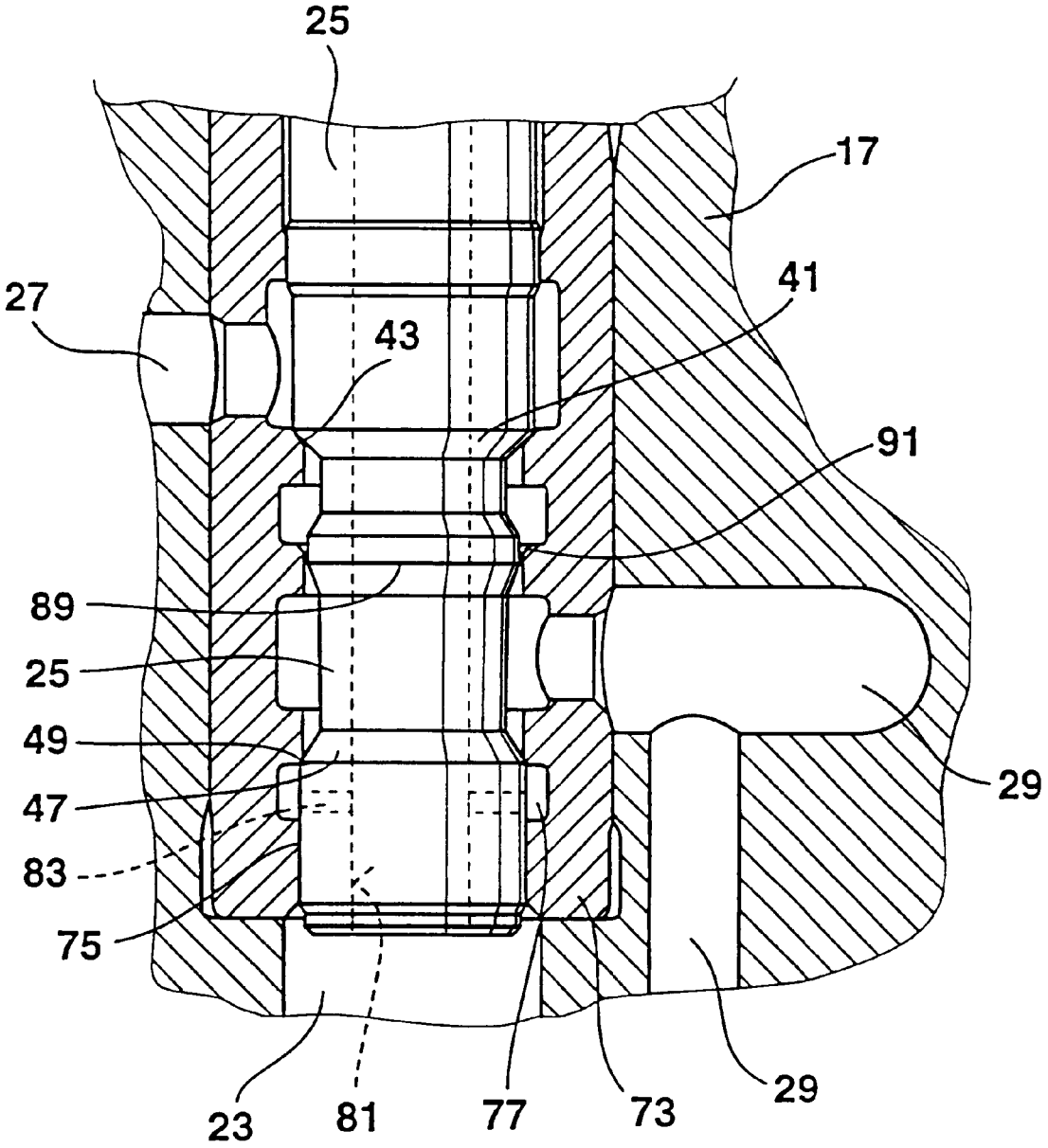
FIG. 5 shows a fourth exemplary embodiment, analogous to the view of FIG. 3, with a stroke-controlled throttle between the two valve seats on the control valve.

The fourth exemplary embodiment of the fuel injection device, shown in FIG. 5, is embodied analogously to the second exemplary embodiment shown in FIG. 3 and additionally has a stroke-controlled throttle between the first and second sealing seats. This stroke-controlled throttle is embodied by an annular collar 89 on the control valve member 25 whose transitional regions to the adjoining shaft portion of the control valve member 25 are embodied conically. This annular collar 89 cooperates with an annular rib 91 on the wall of the through bore 23 in such a way that when the first valve sealing face 41 is on the first valve seat 43, the annular collar coincides with this sealing face. During the adjusting stroke motion of the control valve member 25 in the direction of the magnet valve 35, the annular collar 89 constantly emerges from coincidence with the annular rib 91 and in the process, during the opening up of the communication between the injection line 9, or the connecting conduit 27, and the high-pressure conduit 29, constantly uncovers a greater overflow cross section. Thus the high-pressure fuel quantity flowing to the injection valve at the onset of the injection event can be throttled, so that the course of injection at the injection valve 11 can be shaped.

Figure 6:
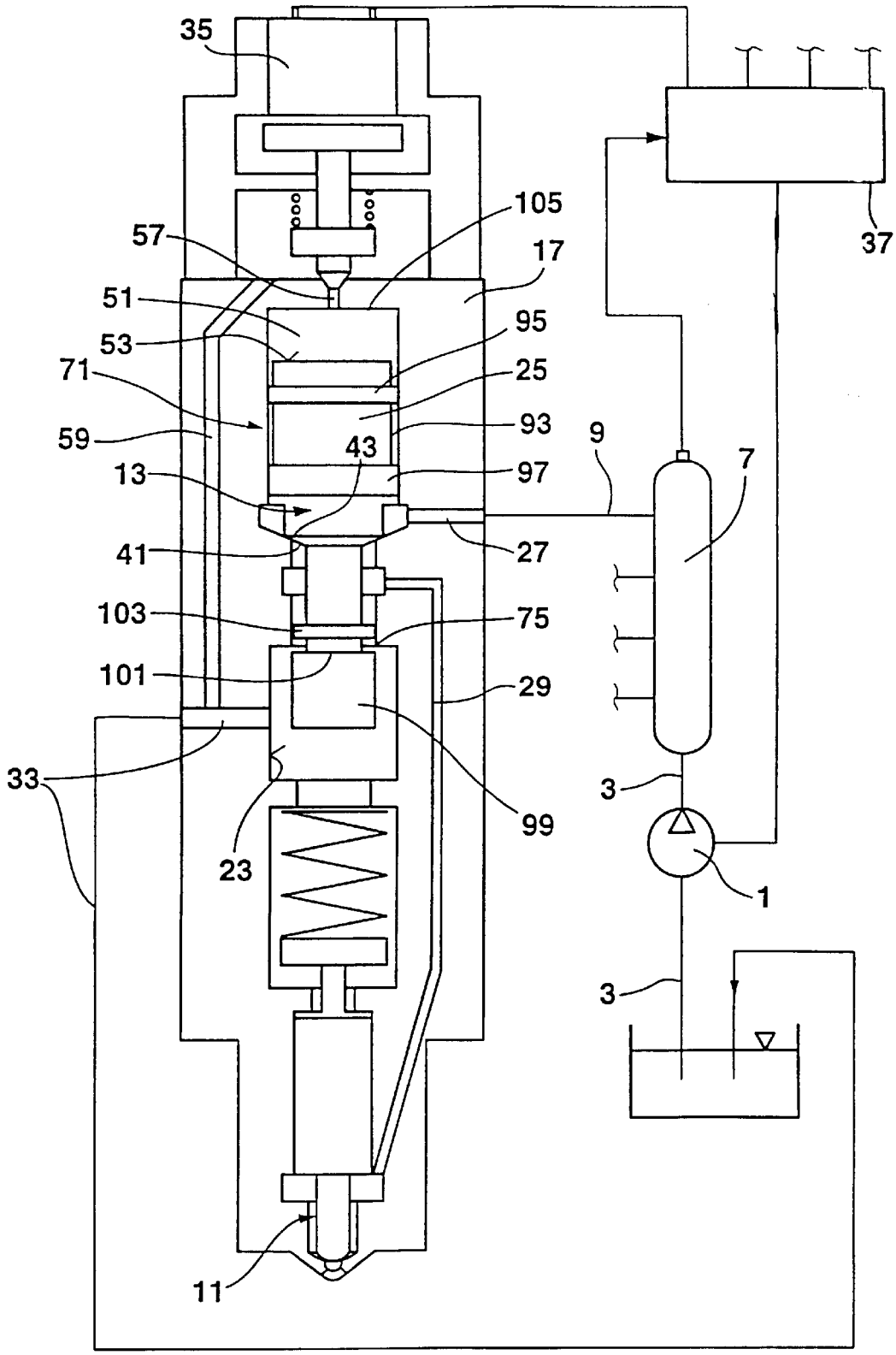
FIG. 6 shows a fifth exemplary embodiment in an overall view, in which the control valve member is in one piece and the second valve seat is embodied a slide valve between the high-pressure conduit and the relief line.

The fifth exemplary embodiment of the fuel injection device, shown in a simplified total view in FIG. 6, differs from the above exemplary embodiments again in the design of the control valve member 25. Here, the annular gap 71 that determines the throttle cross section between the injection line 9 and the work chamber 51 is subdivided by an annular groove 93 into an upper throttle gap 95 and a lower throttle gap 97. Over the axial length of the annular groove 93, the flow through the annular gap 71 between the injection line 9 and the work chamber 51 can now be adjusted precisely. In the fifth exemplary embodiment, the second sealing seat that controls the overflow cross section between the high-pressure conduit 29 and the relief line 33 is embodied as a slide valve seat. To that end, the control valve member 25, on its lower end toward the injection valve 11, has a slide head 99, whose outside diameter is equivalent, except for a very slight play, to the diameter of the through bore 23 in the guide region 75. The upper boundary edge of the slide head 99, toward the magnet valve 35, forms a valve control edge 101, which cooperates with the guide portion 75 of the through bore 23 and whose entry into coincidence with the guide portion 75 of the through bore 23 controls the closing of the connection between the high-pressure conduit 29 and the relief line 33. In addition, the valve control edge 101 of the slide head 99 is preceded by a further annular collar 103 on the control valve member 25; this collar forms an outflow throttle restriction for the high-pressure fuel flowing out of the high-pressure conduit 29 into the relief line 33. The stroke limitation of the control valve member 25 in the direction of the magnet valve 35 is effected, in the fifth exemplary embodiment, by the contact of the upper end face 53 of the control valve member 25 with an end wall 105 that defines the hydraulic work chamber 51.

Figure 7:
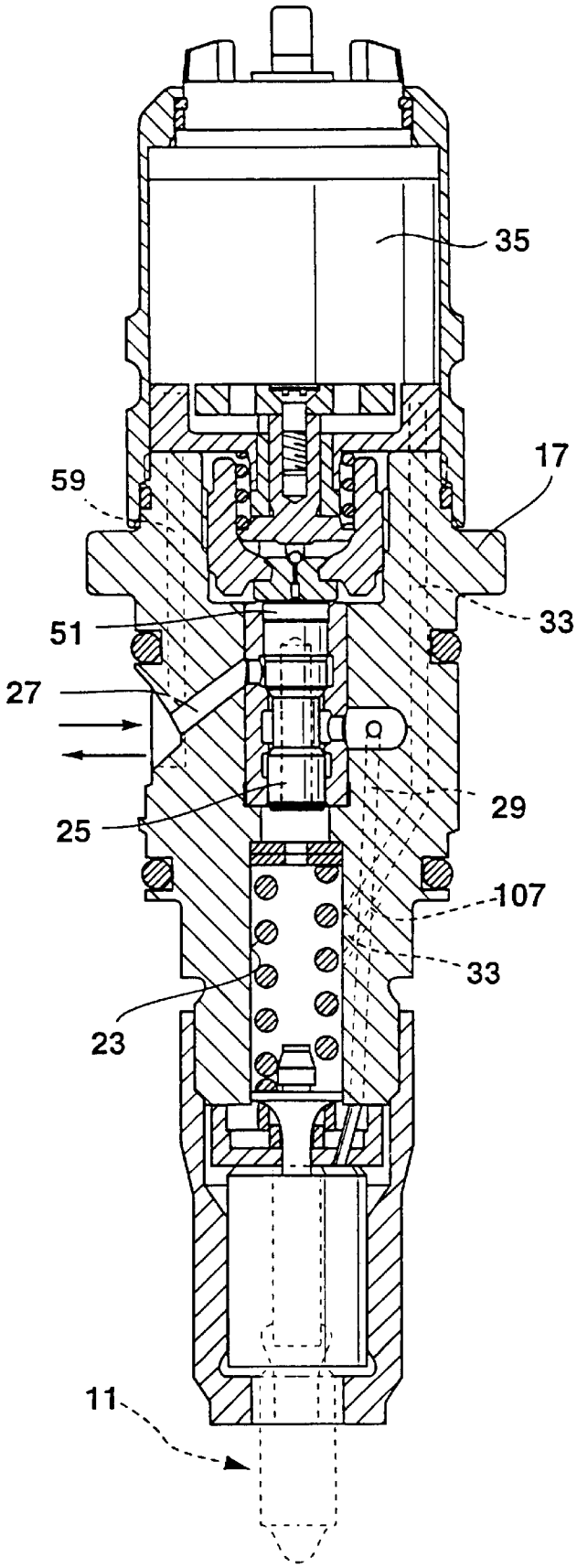
FIG. 7 shows a sixth exemplary embodiment in a section through the injection device, in which a throttle is provided in the relief line.

The sixth exemplary embodiment of the fuel injection device, shown in FIG. 7, is analogous in design to the second exemplary embodiment of FIG. 3 and in addition thereto has a further throttle restriction in the relief line 33. This throttle restriction is formed by a throttle insert 107, inserted into the relief line 33, whose flow cross section is designed such that at the end of injection the closure of the injection valve is reinforced and possible dribbles after injection are prevented. Furthermore, the residual pressure of the fuel remaining at the end of injection in the high-pressure conduit 29 can thus be adjusted such that cavitation damage can be avoided. The fuel is carried from the through bore 23 via the relief bore 33 first to the magnet valve 35 and from there is diverted via the return conduit 59 to the low-pressure chamber 5. This flow through the magnet valve 35 has the advantage that during operation of the fuel injection device, the magnet valve chamber can be cooled and ventilated.

Figure 8:
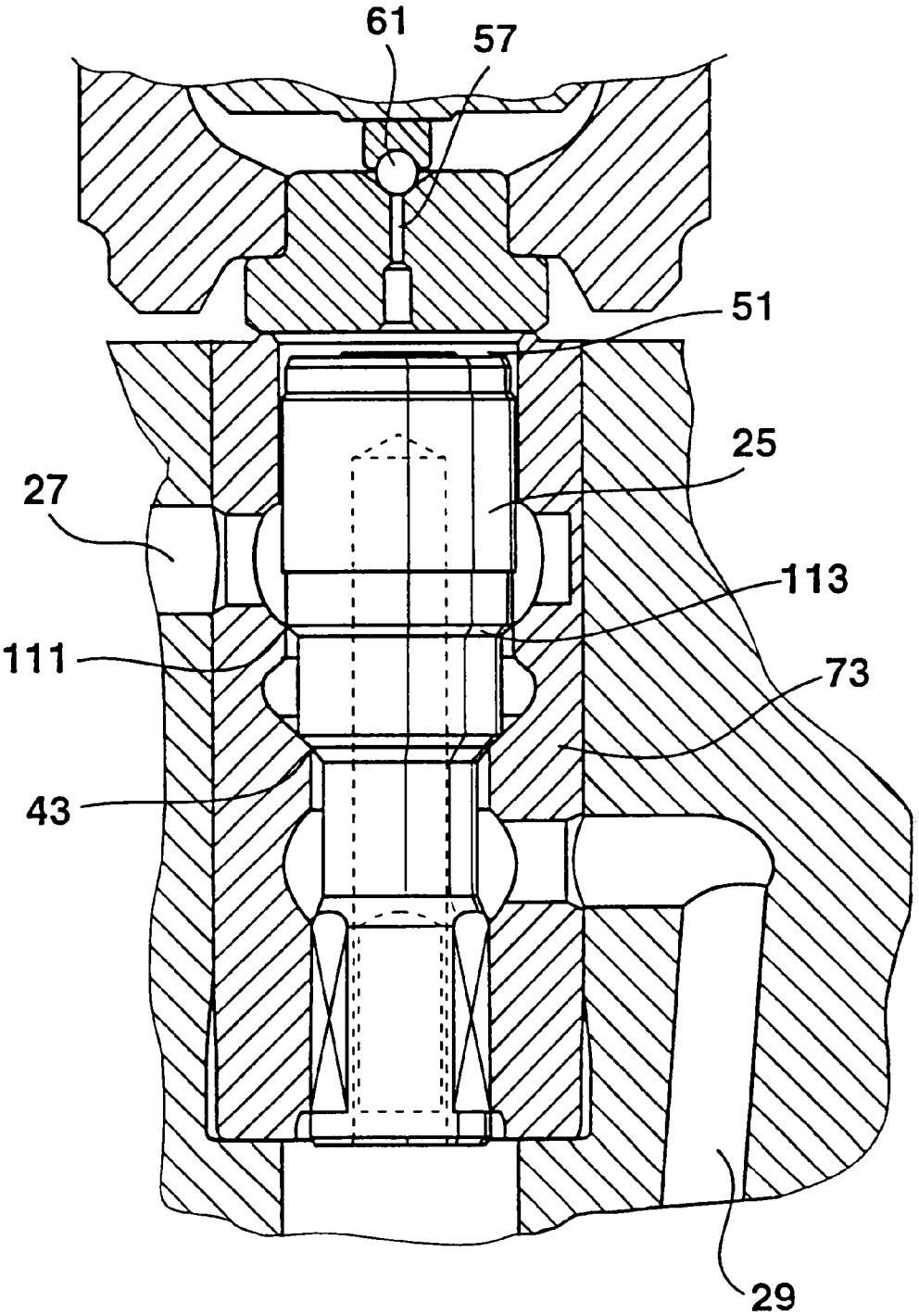
FIG. 8 shows a seventh exemplary embodiment, in which an additional throttle restriction is provided between the high-pressure inlet and the valve seat.

FIG. 8 shows a seventh exemplary embodiment, whose design is substantially equivalent to that of the third exemplary embodiment shown in FIG. 4.

In the seventh exemplary embodiment in FIG. 8, one additional throttle restriction 111 is provided between the high-pressure inlet conduit 27 and the valve seat 43; by way of this throttle restriction, the flow of injection fuel in the opening stroke phase, particularly at its onset, can be controlled, and by means of it the closing stroke motion of the control valve member 25 can be damped. In the seventh exemplary embodiment, this throttle restriction 111 is embodied as a narrow gap between the inner wall of the cylinder bush 73 and the control valve member 25; a shoulder 113 is provided in the control valve member 25, through which shoulder the narrow gap is opened, into a greater flow cross section, after a certain opening stroke of the control valve member 25.

The foregoing relates to a preferred exemplary embodiment of the invention, it being understood that other variants and embodiments thereof are possible within the spirit and scope of the invention, the latter being defined by the appended claims.

We claim:

1. A fuel injection device for internal combustion engines, comprising a common high-pressure collection chamber (7), which can be filled with fuel from a high-pressure pump (1) and which communicates via injection lines (9) with a plurality of injection valves (11) whose opening and closing motions are each controlled by an electrically triggered control valve (13) disposed on each injection valve (11), the control valve (13) being embodied as a 3/2-way valve with a control valve member (25), said control valve member (25) has two sealing faces (41, 47) and connects a high-pressure conduit (29) with the injection line (9) or a relief line (33), said high pressure conduit (29) discharges at an injection port of the injection valve (11), the control valve member (25) is actuatable by a pressure prevailing in a work chamber (51) counter to a hydraulic restoring force, and the pressure in the work chamber (51) is controllable by means of a constant inflow and a controlled outflow.

2. The fuel injection device according to claim 1, in which the work chamber (51) is embodied as a hydraulic work chamber (51), which can be filled with fuel at a high pressure, at the control valve member (25) of the 3/2way control valve (13), the fuel at high pressure acts upon the control valve member (25), counter to the hydraulic restoring force which engages the control valve member, wherein the high pressure fuel in the hydraulic work chamber pushes the control valve member in a direction of closing the flow between the injection line (9) and the high-pressure conduit (29) and opens the injection line to the relief chamber.

3. The fuel injection device according to claim 2, in which the hydraulic work chamber (51) is defined by an upper end face (53) of the pistonlike control valve member (25) and communicates constantly via a throttle cross section (69, 71) with the injection line (9) and with a closable relief conduit (57), which leads away from the work chamber (51) and whose cross section is embodied as greater than the throttle cross section to the injection line (9) and which can be opened and closed by means of an electrical adjusting valve (35).

4. The fuel injection device according to claim 3, in which the electrical adjusting valve (35) is embodied as a magnet valve, whose actuator is embodied by a valve ball (61), which cooperates with a valve seat adjoining the relief conduit (67).

5. The fuel injection device according to claim 3, in which the throttle cross section to the injection line (9) is formed by a throttle bore (69) in the control valve member (25).

6. The fuel injection device according to claim 1, in which the 3/2-way control valve (13) is embodied as a double seat valve, having a first sealing seat (41, 43) that controls the flow between the injection line (9) and the high-pressure conduit (29) and a second sealing seat (47, 49), which controls the flow between the high-pressure conduit (29) and the relief line (33), the two valve seat faces (43, 49) being disposed facing one another and each defining the adjusting motion of the control valve member (25) in one stroke direction.

7. The fuel injection device according to claim 3, in which the throttle cross section between the work chamber (51) and the injection line (9) is embodied as an annular gap (71) between the circumferential surface of the pistonlike control valve member (25) and the wall of a cylinder bore (23) guiding it.

8. The fuel injection device according to claim 1, in which the pistonlike control valve member (25) is embodied in one piece.

9. The fuel injection device according to claim 3, in which on the control valve member (25), an annular face (39) is provided in the region of the coincidence with the injection line (9), at which face the high fuel pressure engages the control valve member (25) in the opposite direction of the adjustment direction of the hydraulic work chamber (51) so as to provide said hydraulic restoring force.

10. The fuel injection device according to claim 6, in which a through opening is provided on the control valve member (25) between the second sealing seat (47, 49) and the relief line (33).

11. The fuel injection device according to claim 10, in which the flow opening is embodied as a blind bore (81), which discharges into the relief line (23, 33) and into which a transverse bore (83) discharges.

12. The fuel injection device according to claim 10, in which the through opening is embodied as a surface chamfer (85) on the control valve member (25), which is opened only after the closure of the transition cross section between the injection line (9) and the high-pressure conduit (29).

13. The fuel injection device according to claim 6, in which a stroke-controlled throttle (89, 91) is provided between the first and second sealing seats (43, 49) and throttles the high-pressure fuel quantity, flowing from the injection line (9) to the high-pressure conduit (29), in a first phase of the injection event.

14. The fuel injection device according to claim 1, in which a throttle restriction (107) is inserted into the relief line (33) that can be opened by the control valve (13).

* * * * *